US005213538A

United States Patent [19]

Willett

[11] Patent Number: 5,213,538

[45] Date of Patent: May 25, 1993

[54] POP-ACTION BOUNCING DOLL

[75] Inventor: William Willett, Orange, Calif.

[73] Assignee: Mattel, Inc., El Segundo, Calif.

[21] Appl. No.: 823,231

[22] Filed: Jan. 2, 1992

[51] Int. Cl.[5] ..... A63H 33/00; A63H 13/10; A63B 65/00

[52] U.S. Cl. ..... 446/4; 446/308; 446/486; 273/428

[58] Field of Search ..... 446/4, 6, 97, 99, 268, 446/308, 309, 310, 311, 312, 320, 321, 325, 326, 486; 273/58 K, 424, 428

[56] References Cited

U.S. PATENT DOCUMENTS

| | | | |
|---|---|---|---|
| 202,990 | 4/1878 | Chinnock | 446/311 |
| 564,686 | 7/1896 | Gottschalk | 446/310 X |
| 847,755 | 3/1907 | Flora | 446/311 |
| 1,396,766 | 11/1921 | McClelland | 446/321 |
| 1,407,165 | 2/1922 | Pajeau | 446/268 X |
| 1,538,704 | 5/1925 | Kay | 446/308 |
| 1,676,296 | 7/1928 | Spencer | 273/428 X |
| 2,153,957 | 4/1939 | Davis | 446/484 |
| 2,627,700 | 2/1953 | Weiss | 446/312 |
| 3,108,395 | 10/1963 | Goldfarb | 446/311 |
| 3,501,861 | 3/1970 | Geldfarb et al. | 446/311 X |
| 4,120,117 | 10/1978 | Terzian et al. | 446/308 |
| 4,212,460 | 7/1980 | Kraft | 446/4 X |
| 4,219,959 | 9/1980 | Fleischer | 446/486 |
| 4,795,398 | 1/1989 | Wexler | 446/310 X |
| 4,802,880 | 2/1989 | Shaw | 273/94 |

FOREIGN PATENT DOCUMENTS

| | | | |
|---|---|---|---|
| 280867 | 4/1952 | Canada | 446/321 |
| 336081 | 2/1904 | France | 446/310 |
| 383919 | 1/1908 | France | 446/321 |
| 1164900 | 10/1958 | France | 446/310 |
| 2618347 | 1/1989 | France | 273/424 |

*Primary Examiner*—Robert A. Hafer
*Assistant Examiner*—D. Neal Muir
*Attorney, Agent, or Firm*—Roy A. Ekstrand

[57] ABSTRACT

A pop-action doll includes a resilient bistable hemispherical support member together with a dome-shaped hat portion. A head and torso are secured to the resilient member and the hat portion. The resilient member may be configured in an open position in which it extends downwardly and provides a stable support for the torso, head and hat portions of the doll. Alternatively, the resilient member may be deformed to an alternate stable configuration in which the torso and head portions are enclosed within the domed hat and the resilient member in a "clamshell" type configuration. When in the closed configuration, any impact of the doll against a play surface causes the resilient member to rapidly switch to its alternate configuration in a pop-action which in turn causes the doll to rebound dramatically from the impacted play surface.

9 Claims, 2 Drawing Sheets

POP-ACTION BOUNCING DOLL

FIELD OF THE INVENTION

This invention relates generally to dolls and toy figures and particularly to those employing a spring bouncing action.

BACKGROUND OF THE INVENTION

Dolls and toy figures constitute one of the most long lasting and pervasive general categories of toys and amusement devices produced through the years. Such dolls and toy figures have taken a virtually endless variety of shapes, sizes and configurations. The continuing popularity of dolls and toy figures is due in some part to the persistent efforts of practitioners in the art to provide evermore interesting and amusing dolls and toy figures. In attempting to add interest and variety to such dolls and other toy figures, practitioners have provided dolls having different sizes, shapes, configurations and action. Dolls and toy figures have been provided which walk, skate, crawl, sing, cry and so on.

One such type of doll or toy figure which provides increased amusement and enjoyment may be generally described as impact-responsive or bouncing type dolls or toy figures. Such toys are provided in various shapes and configurations but generally all include a confined spring element which "snaps" to provide a launching or rebounding type of action.

For example, U.S. Pat. No. 4,802,880 issued to Shaw sets forth a LEAPFROG AND FOOTBALL GAME in which a spring member defines a thin flexible convex surface having at least two curved perimetral edge formations wherein the convex surface is adapted to bear against a second surface and is manipulatively elasticly deformable against a second surface so as to leap therefrom when the convex surface returns to its original shape. Embodiments are shown for a flexible element in the shape of a football and additionally a flexible element support appendages in the configuration of a frog.

U.S. Pat. No. 1,676,296 issued to Spencer sets forth a FIGURE TOY in which a doll-like toy figure is secured to a cupped or curved disk formed of two metallic materials to provide a temperature sensitive bimetallic disk having a curvature which responds to temperature. In operation, the disk is heated and thereafter manually forced to reverse curvature. Thereafter, the cooling of the disk causes a bimetallic layer thereof to reverse the disk curvature in a snap action which launches the toy figure in apparent spontaneous action.

U.S. Pat. No. 2,153,957 issued to Davis sets forth a JUMPING TOY in which a generally hemispherical body is formed of a stiff or hard rubber material. The hemispherical body may be deformed to a generally reversed hemispherical shape and will retain such shape in the absence of a disturbing force. In its intended play pattern, the toy may be placed or thrown against a play surface such as a table-top or floor producing an impact which causes the hemispherical member to snap back to its original shape thereby producing a rebounding or bouncing action.

U.S. Pat. No. 202,990 issued to Chinnock sets forth a JUMPING TOY in which a doll body supports an elongated flexible outer garment and a downwardly extending center pin in the garment interior. A base member includes a generally planar element supporting an upwardly extending cylindrical member. A coil spring is captivated between the cylindrical member and the downwardly extending pin and the doll garment is secured along its lower edge to the base member. In its intended play pattern, the doll torso is forced downwardly against the base causing the captivated spring to be compressed and the pin member to be received within the cylindrical element. The pin is latched into the cylindrical element captivating the compressed spring. Upon release of the pin member, the spring force caused by the expanding spring produces a jumping action for the doll.

U.S. Pat. No. 3,108,395 issued to Goldfarb sets forth an IMPACT REACTION TOY HAVING TWO PORTIONS SECURABLE TOGETHER BY AN IMPACT RESPONSIVE LATCHING MECHANISM. A spring member is captivated between the toy portions and is compressed in the latched position. In operation, the latch is released in response to impact against the toy causing one portion to be ejected from the other. In the preferred embodiment shown, the toy is formed in a top-like fashion in which the ejected portion comprises an independently functioning top.

U.S. Pat. No. 4,120,117 issued to Terzian, sets forth an ARTICULATED FIGURE TOY in which a multiply-articulated toy figure includes a spring mechanism operable in a bistable manner to provide relative motion of selected body portions and appendages with respect to the torso portion in response to impact against the doll figure.

U.S. Pat. No. 1,538,704 issued to Kay sets forth a BOUNCING TOY defining an interior cavity within which a heavy spherical weight is supported. The weight is movable to either end of the elongated cavity within the doll interior to provide apparent spontaneous motion of the doll.

A multiply configurable doll manufactured and sold by Tonka Corporation under the trademark "Cupcakes" comprises a doll figure having a torso replicating a young female child wearing a dress and hat. A flexible cup member resembling a cupcake baking cup is supported beneath the doll's dress and extends downwardly therefrom. The hat describes a generally convex disk-like member configured to resemble the frosting portion of a cupcake. The doll may be alternately configured by reversing the flexible member to an alternate upwardly extending configuration in which it partially encloses the doll torso. When alternately configured, the hat and flexible member generally converge to completely enclose the doll figure and produce a cupcake-like appearance.

While the foregoing described prior art devices have increased the variety and enjoyment of several types of dolls and toy figures, there remains nonetheless a continuing need in the art for evermore improved, enjoyable and amusing dolls and toy figures.

SUMMARY OF THE INVENTION

Accordingly, it is a general object of the present invention to provide an improved doll or toy figure. It is a more particular object of the present invention to provide an improved doll or toy figure having a pop-action bouncing characteristic. It is a still more particular object of the present invention to provide an improved doll or toy figure in which the pop-action or bouncing characteristic is integrally related to a multiply configurable structure.

In accordance with the present invention, there is provided a pop-action bouncing doll comprises: a generally hemispherical resilient member deformable from a first position to a second position; a doll torso having a first end secured to the resilient member and a second end; and an upper portion secured to the second end, the resilient member providing a stable support base in the first position characterized by a downwardly extending convex dome and an upwardly extending closure member in the second position and a resilient force releasible upon impact urging the resilient member toward the first position.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENT

Figures 1, 2:
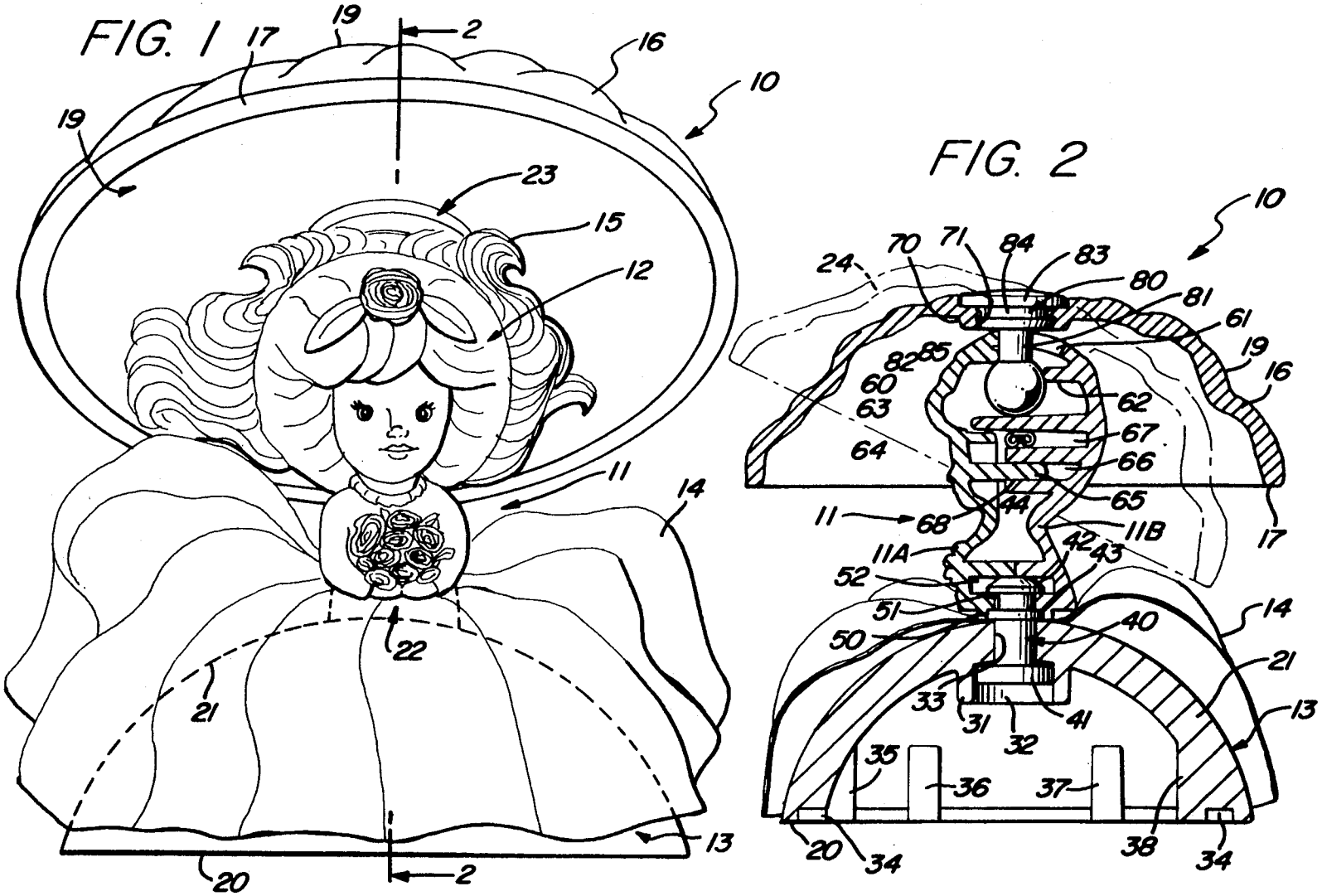
FIG. 1 sets forth a front view of the present invention doll in its open position.
FIG. 2 sets forth a section view of the present invention doll taken along section lines 2—2 in FIG. 1.

FIG. 1 sets forth a front view of a doll constructed in accordance with the present invention and generally referenced by numeral 10. At the outset, it should be apparent to those skilled in the art that while the embodiment shown for the present invention doll is that of a human-like doll, the present invention may be utilized equally well with a variety of figures, both human resembling and otherwise without departing from the spirit and scope of the present invention. However, for purposes of clarity of explanation, the term doll will be used in the description of the figures that follow to include both dolls and toy figures of different shapes. Doll 10 is fabricated to resemble a fanciful depiction of a young girl or the like. Thus, doll 10 includes a torso 11, a head 12 and a quantity of hair 15 all configured in accordance with the appearance of a fanciful young girl. Doll 10 further includes a skirt portion 14 extending downwardly from torso 11 which, in its preferred form, is fabricated of a light and flexible cloth material or the like. Doll 10 further includes a hat 16 defining an outer edge 17, an outer surface 19 and an interior cavity 18 in a generally hemispherical or domed configuration. Doll 10 further includes an attachment 23, the structure of which is set forth below in greater detail. Suffice it to note here, however, that attachment 23 secures hat 16 to head 12 in a movable attachment which permits hat 16 to be angled as shown in FIG. 1 exposing the upper portion of head 12 or, alternatively, in a generally horizontal position such as that shown in FIG. 2.

Doll 10 further includes a generally hemispherical cup 13 secured to torso 11 by an attachment 22 (better seen in FIG. 2). Resilient cup 13 defines a lower edge 20 and a curved portion 21. In its preferred form, resilient cup 13 is fabricated of a resilient material such as rubber and is deformable from the position shown in FIG. 1 to an alternate configuration shown in FIG. 3.

In the configuration shown in FIG. 1, doll 10 may be used in accordance with conventional doll play patterns and provides an attractive and interesting doll which is capable of free-standing upon edge 20 in a stable manner. In accordance with an important aspect of the present invention explained below in greater detail, doll 10 may be alternatively configured to the position shown in FIG. 3 by pivoting hat 16 to a generally horizontal orientation and deforming resilient cup 13 upwardly in the manner shown in FIG. 3 to provide closure between edge 20 of resilient cup 13 and edge 17 of hat 16. The resulting structure forms a clamshell-like structure in which resilient cup 13 is stressed or deformed into an alternate shape. The resilience of cup 13 provides a bistable characteristic for cup 13 in which it remains in either of the alternate positions shown in FIG. 3 but when disturbed quickly snaps to the configuration shown in FIG. 1. Thus, in accordance with an important aspect of the present invention, doll 10 may be configured in the closed position of FIG. 3 and, when subjected to an impact, caused to rebound or bounce dramatically due to the snap-action of resilient cup 13 as it returns to the position shown in FIG. 1.

FIG. 2 sets forth a section view of doll 10 taken along section lines 2—2 in FIG. 1. As described above, doll 10 includes a generally domed-shaped hat 16 defining an interior cavity 18, an outer surface 19 and a lower edge 17. As is also described above, doll 10 includes a torso 11, a head 12 and a hemispherical resilient cup 13. Resilient cup 13 is preferably formed of a hard rubber material or the like and includes a curved portion 21, a lower edge 20 and an interior cavity 30. A groove 34 is formed within edge 20 and a plurality of downwardly extending rib portions such as rib portions 35 through 38 are spaced about the interior of resilient cup 13 and extend downwardly to a coplanar relationship with edge 20. Resilient cup 13 further defines a center aperture 33 and a cylindrical boss 31 extending downwardly within interior cavity 30. Boss 31 is generally concentric with aperture 33 and defines a cylindrical recess 32 therein.

Torso 11 defines an interior cavity 60 and, in its preferred form, comprises a pair of torso halves 11A and 11B formed of a molded plastic material or the like which combine to form torso 11 and which are joined using conventional fabrication techniques. Torso 11 defines an aperture 50 having an inwardly extending ridge 51 and a closed cavity 52 formed therein. An attachment pin 40 defines a generally cylindrical member having a pair of flanges 42 and 43 separated by a groove 44 and a head 41. Pin 40 is received within aperture 33 of resilient cup 13 such that head 41 is received within recess 32. Torso 11 defines an inwardly extending ridge 51 which is received within groove 44 of attachment pin 40 and which is captivated between flanges 42 and 43 thus providing a pivotal attachment between torso 11 and resilient cup 13.

Torso 11 further defines an upwardly facing slot 61 and a plurality of inwardly extending rib portions 62, 63, 64, 65 and 68. To provide secure attachment between torso halves 11A and 11B, rib portion 65 is received within the space 66 between ribs 64 and 68. As mentioned above, the attachment of torso halves 11A and 11B may be completed using conventional attachment methods such as adhesive or sonic welding. Hat 16 defines a center aperture 70 having an inwardly extending ridge formed therein. An attachment pin 80 defines a cylindrical shank portion 81 and a spherical end 82. Shank 81 is received within slot 61 of head portion 12 and is captivated therein. Rib members 62 and 63 cooperate with slot 61 to retain spherical portion 82 within interior cavity 60. In addition, a spring 72 is captivated within space 67 between ribs 63 and 64 to provide a resilient force urging rib 63 against spherical portion 82 of pin 80. Pin 80 further defines a head portion 83 having a groove 84 formed therein. Head 83 is received within aperture 70 such that rib 71 extends into and is captivated within groove 84 to provide attachment between pin 80 and hat 16. Thus, hat 16 may be pivoted due to the cooperation between spherical end 82 of pin 80 and ribs 62 and 63 together with slot 61 to permit hat 16 to be aligned in the horizontal position shown in FIG. 2 or, alternatively, pivoted or tilted to the open position shown in dashed line representation 24.

In the preferred method of assembly, pin 40 is inserted into aperture 33 of resilient cup 13 while pin 80 is similarly inserted into aperture 70 of hat 16. Thereafter, torso halves 11A and 11B receive pins 40 and 80 as well as spring 72 in the manner shown in FIG. 1 as half portions 11A and 11B are joined to captivate pins 40 and 80. Thereafter, conventional attachment means are provided to complete assembly and captivate pins 40 and 80 within cavities 52 and 60 respectively.

Figure 3:
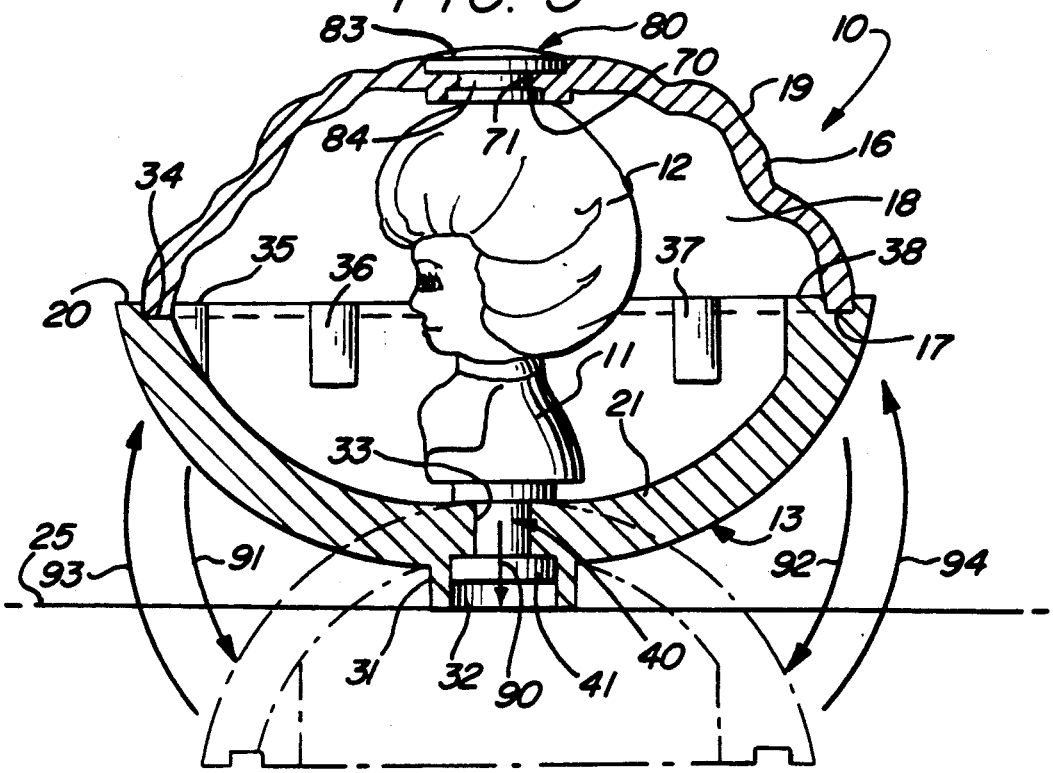
FIG. 3 sets forth a partially sectioned view of the present invention doll in the closed position.

FIG. 3 sets forth a partially sectioned view of doll 10 in its closed or spring-loaded configuration. For purposes of clarity, skirt 14 has been omitted from FIG. 3 together with portions of hair 15. Thus, doll 10 includes a generally domed hat portion 16 defining a center aperture 70, an interior cavity 18 and a lower edge 17. Torso 11 and head portion 12 of doll 10 are pivotally secured to hat 16 by the above-described attachment using pin 80 which, as described above, is captivated within aperture 70 by the cooperation of ridge 71 and groove 84. Doll 10 further includes resilient cup 13 which, as described above, defines a center aperture 33, an edge 20, a groove 34 and a plurality of ribs equally spaced about groove 34 such as ribs 35 through 38. In the above-described attachment, pin 40 which includes a head 41 is received within aperture 33 and is surrounded by a cylindrical boss 31 having a recess 32 defined therein. In the configuration shown in FIG. 3, resilient cup 13 has been deformed from the relaxed position shown in FIGS. 1 and 2 by forcing curved portion 21 upwardly with respect to boss 31 such that edge 20 is forced upwardly from the dashed-line position shown in the directions indicated by arrows 93 and 94. The resilient structure of cup 13 produces a bistable member which is stable in the relaxed position shown in dashed-line representation and in the upwardly flexed or closed position shown in FIG. 3 but which is unstable at any position therebetween. Thus, as curved portion 21 is deformed during the reconfiguration of cup 13 and "over-center" action occurs in which resilient cup 13 snaps from the dashed-line configuration in FIG. 3 to that shown in solid-line representation. It should be noted that in the closed configuration of doll 10 shown in FIG. 3, edge 17 of hat 16 is received within groove 34 and is captivated therein by the cooperation of ribs 35 through 38. As mentioned above, while ribs 35 through 38 are shown in the section views of FIGS. 2 and 3, it should be understood that a corresponding plurality of ribs are spaced about the entire periphery of resilient cup 13. Thus, the resilient character of cup 13 causes it to remain in the position in FIG. 3 so long as no impacting force is applied to doll 10. As a result and in accordance with an important aspect of the present invention, doll 10 may be configured in the closed configuration shown in FIG. 3 in a stable relationship and will remain as configured indefinitely.

In accordance with an important aspect of the present invention once resilient cup 13 has been deformed to the closed configuration shown in FIG. 3, the impact of doll 10 upon a play surface 25 in the direction indicated by arrow 90 causes resilient cup 13 to be temporarily flexed as boss 31 impacts surface 25. During impact, the cooperation of pin 40, torso 11, head 12 together with pin 80 forces hat 16 downwardly against groove 34 of resilient cup 13. Concurrently, curved portion 21 is flexed causing the closed position of resilient cup 13 to be disturbed and releasing the spring force of resilient cup 13. As the spring force of resilient cup 13 is released, it flexes downwardly in the directions indicated by arrows 91 and 92 to return to the position shown in dashed-line representation which corresponds to the stable position shown in FIGS. 1 and 2. Due to the resilience of cup 13, this return to the stable position shown is extremely rapid providing a spring force against surface 25 which in turn accelerates doll 10 upwardly from surface 25 in an extremely rapid bounce or rebound. As a result, the present invention doll when configured in the closed position of FIG. 3 exhibits a pop-action bounce characteristic each time it impacts a surface such as surface 25.

Figure 4:
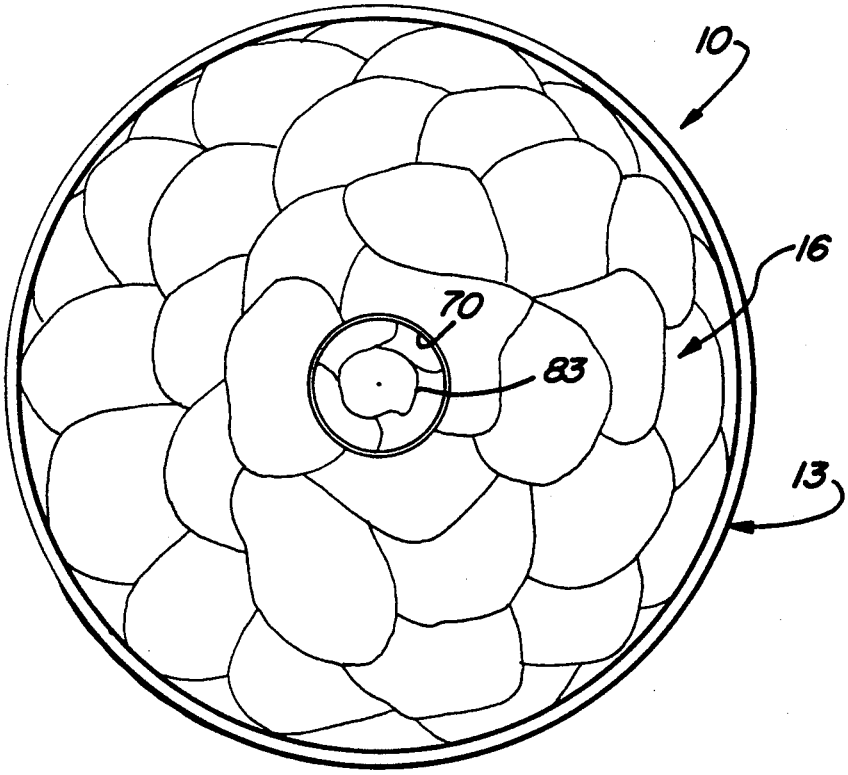
FIG. 4 sets forth a top view of the present invention doll.

FIG. 4 sets forth a top view of doll 10 showing the circular character of hat 16 and resilient cup 13. As is described above, hat 16 defines a center aperture 70 which receives head 83 of pin 80 in the above-described attachment.

Thus, what has been shown is a novel doll structure which utilizes the bistable characteristics of a hemispherical resilient cup portion together with a cooperating domed hat and center torso to provide a doll which may be configured in an open configuration or a closed "clamshell" configuration. In the closed configuration, the resilient bistable force of the hemispherical member provides a spring force which is released upon impact against any play surface causing the doll to exhibit a pop-action bounce characteristic in which the doll rebounds abruptly and returns to a more standard open configuration. The doll is fully stable in either the closed or open positions and exhibits a dramatically different appearance between configurations.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. A pop-action impact-responsive bouncing doll comprising:

a doll torso having first and second ends;

a generally hemispherical resilient member secured to said second end deformable between a stable relaxed first position extending downwardly from said first end to form a convex support therefor and a marginally stable stretched second position extending upwardly toward said second end to form a concave partial enclosure for said torso;

an upper portion secured to said second end, said upper portion defining a generally concave surface receiving a portion of said torso and an outer edge, said resilient member providing an upwardly extending closure member when elastically deformed into said second position such that said resilient member and said upper portion at least substantially enclose said torso for producing resilient force releasible upon impact urging said resilient member toward said first position and launching said doll.

2. A pop-action bouncing doll as forth in claim 1 wherein said upper portion is generally dome-shaped and defines a downwardly extending convex dome.

3. A pop-action bouncing doll as set forth in claim 2 wherein said second end of said torso includes a head and wherein said first end includes a waist.

4. A pop-action bouncing doll as set forth in claim 3 wherein said upper portion resembles a hat.

5. A pop-action bouncing doll as set forth in claim 3 further including attachment means for securing said upper portion to said second end in a tiltable attachment.

6. A pop-action bouncing doll as set forth in claim 3 wherein said upper portion defines an outer edge and wherein said resilient member defines a receiving portion for engaging said outer edge of said upper portion in said second position.

7. A pop-action bouncing doll as set forth in claim 6 wherein said receiving portion includes an edge defining a groove for receiving said outer edge.

8. A pop-action bouncing doll as set forth in claim 7 wherein said receiving portion includes a plurality of rib members spaced about said groove.

9. A doll comprising:

a resilient generally hemispherical member having a stable open position, in which said member defines a convex outer surface, a concave inner surface and a first outer edge;

a doll torso having a head portion and a waist portion;

an upper closure member having a second outer edge;

first attachment means for securing said upper closure member to said head portion; and second attachment means for securing said waist portion to said resilient hemispherical member such that said first outer edge supports said doll, said resilient hemispherical member being deformable from said open position to a marginally stable closure position in which said convex outer surface becomes a concave inner surface at least partially enclosing said doll torso and in which said concave inner surface becomes a convex outer surface and said first and second outer edges generally meet and in which a resilient force is created which is released upon impact against said resilient member returns said resilient member to said open position.

* * * * *